US008622240B2

(12) United States Patent
Krasucki et al.

(10) Patent No.: US 8,622,240 B2
(45) Date of Patent: Jan. 7, 2014

(54) RECLOSABLE POUR SYSTEMS FOR CONTAINERS

(75) Inventors: Amy Johnson Krasucki, Maplewood, MO (US); Edgar Merino, Waco, TX (US); Brian Scott Canady, Cambridge City, IN (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 13/200,300

(22) Filed: Sep. 22, 2011

(65) Prior Publication Data

US 2012/0074159 A1 Mar. 29, 2012

Related U.S. Application Data

(60) Provisional application No. 61/403,909, filed on Sep. 23, 2010.

(51) Int. Cl.
*B65D 5/72* (2006.01)

(52) U.S. Cl.
USPC ..... 220/833; 229/215; 229/217; 229/218; 229/222

(58) Field of Classification Search
USPC ..... 220/833; 229/141, 155, 162.3, 215, 229/217, 218, 219, 220, 221, 222
See application file for complete search history.

(56) References Cited

U.S. PATENT DOCUMENTS

| | | | | | |
|---|---|---|---|---|---|
| 1,585,494 | A * | 5/1926 | Harvey | 229/122 |
| 3,037,679 | A * | 6/1962 | Metzger | 229/218 |
| 3,142,432 | A * | 7/1964 | Davis | 229/126 |
| 3,521,809 | A * | 7/1970 | Zimmerman | 229/207 |
| 3,528,597 | A * | 9/1970 | Zastrow | 229/221 |
| 3,944,128 | A * | 3/1976 | Hogan | 229/221 |
| 5,518,174 | A * | 5/1996 | Botterman | 229/207 |
| 5,865,353 | A * | 2/1999 | Baudin | 222/546 |
| 5,893,513 | A * | 4/1999 | Stone et al. | 229/215 |
| 6,739,475 | B2 * | 5/2004 | San Martin et al. | 221/150 R |
| 8,118,199 | B2 * | 2/2012 | Wilbur | 222/565 |
| 2009/0152338 | A1 * | 6/2009 | Wagner et al. | 229/215 |

* cited by examiner

*Primary Examiner* — Steven A. Reynolds
*Assistant Examiner* — Javier A Pagan
(74) *Attorney, Agent, or Firm* — Julie M. Lappin; Janet E. Reed

(57) ABSTRACT

Reclosable pour systems useful on any suitable container and containers comprising the reclosable pour systems are disclosed. The system features a pour opening comprising a hinged flap and a tab that enables latchable reclosing and reopening of the pour opening, to allow the pouring of a flowable material contained within the container. A unitary blank capable of being cut and folded to produce a container comprising the reclosable pour system, as well as methods of manufacture and use of a container comprising the reclosable pour system, are also disclosed.

18 Claims, 5 Drawing Sheets

RECLOSABLE POUR SYSTEMS FOR CONTAINERS

CROSS REFERENCE TO RELATED APPLICATIONS

This application claims priority to U.S. Provisional Application Ser. No. 61/403,909 filed Sep. 23, 2010, the disclosure of which is incorporated herein by this reference.

BACKGROUND OF THE INVENTION

1. Field of the Invention

The present invention relates generally to containers and particularly to reclosable pour systems for containers.

2. Description of Related Art

Many materials, including flowable materials, are shipped in some form of box or Carton. Frequently these containers are "sift proof" containers. Sift proof containers do not need an inner lining (such as a plastic bag) to keep the flowable material from sifting through the carton and leaking. Current sift proof containers are often made of paperboard or corrugated box material and adhesive, although other materials can be used. Such cartons are also frequently made as a unitary structure that is foldable into the desired container shape.

To allow the consumer to remove materials from sift proof containers, some form of opening is required. In some instances, the container simply possesses a tear strip near the top of the container. Pulling this tear strip results in a slit being formed along three of the container sidewalls. The top of the container is then free to be pulled open; the remaining sidewall acts as a hinge. Though this system is rather simple, it is disadvantageous because the opening is difficult to pour from and because the relatively large opening cannot typically be reclosed in a latchable fashion.

Alternatively, some sift proof containers possess a reclosable spout. One way this is accomplished is through the addition of a metal or plastic pour spout to the container. However, use of such spouts is disadvantageous since these spouts increase the cost of the containers. Because of this, some containers employ cardboard pour spouts or other types of cardboard pouring devices.

Various examples of containers with paperboard or cardboard pouring devices can be found in U.S. Pat. Nos. 5,452,850, 7,581,673, and 5,531,376. Each of these patents generally discloses a paperboard or cardboard carton made from a unitary sheet of material that has been cut and folded in such a way so as to provide a pour flap. For instance, the '850 patent describes a container that has holes in the top of the container through which a flowable material can be poured, with a reclosable cardboard flap covering those holes. In this case, the flap is reclosed by pushing it down until it frictionally engages a cardboard cutout of nearly the same size and shape as the flap. Alternatively, the '376 patent discloses a carton that possesses a reclosable spout that opens in a downward, drawbridge-like fashion, the pour spout possessing a pour spout body and pour spout wings, the wings guiding the spout and helping to ensure that it is not pulled out too far as a user pulls the spout outwards to open the package. These containers possess several shortcomings and disadvantages. For instance, the flaps may interfere with the use of a top handle on the carton or the flaps may not close properly after a relatively small number of open-close cycles due to the flap or latching device becoming worn or misshapen. There is, therefore, a need for improved reclosable pour systems for containers.

SUMMARY OF THE INVENTION

It is, therefore, an object of the invention to provide reclosable pour systems suitable for use in containers It is another object of the invention to provide reclosable pour systems for containers used for repeated dispensing of flowable materials.

It is a further object of the invention to provide containers that utilize a reclosable pour system.

It is yet another object of the invention to provide unitary blanks for forming containers comprising a reclosable pour system.

It is another object of the invention to provide methods of making containers comprising a reclosable pour system.

It is still another object of the invention to provide methods of obtaining products from containers comprising a reclosable pour system.

It is another object of the invention to provide products comprising containers of the invention and one or more materials in the containers.

These and other objects are achieved using novel reclosable hinged pour systems and containers employing at least one reclosable hinged pour system. Generally, the reclosable pour systems feature a pour opening that comprises a hinged flap and a tab that enables latchable reclosing and reopening of the pour opening, to allow the pouring of flowable materials contained within the containers. Unitary blanks capable of being cut and folded to produce containers comprising the reclosable pour system, as well as methods of manufacture and use of containers comprising the reclosable pour system of the invention, are also provided.

Other and further aspects, objects, features, and advantages of the invention will be readily apparent to those skilled in the art.

BRIEF DESCRIPTION OF THE FIGURES

FIG. 2 illustrates a cross-sectional view of the reclosable pour system illustrated in FIG. 1 taken along line A-A.

FIG. 5 illustrates a cross-sectional view of the reclosable pour system of the container shown in FIG. 3 taken along line B-B.

DETAILED DESCRIPTION OF THE INVENTION

Figure 1A:
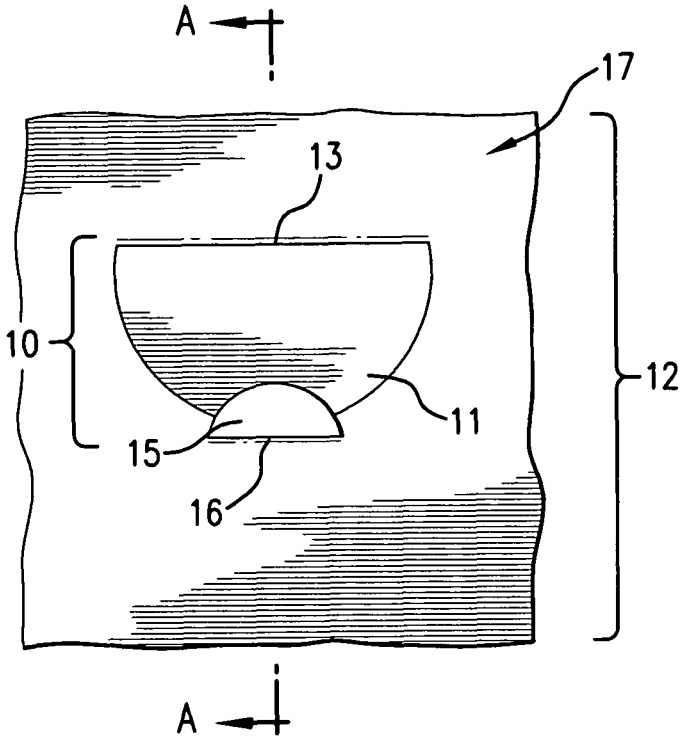
FIG. 1 illustrates a perspective view of a reclosable pour system of the invention with hinged flap in the closed (FIG. 1A) and open (FIG. 1B) position.

In one aspect, the invention provides reclosable pour systems for containers. The systems comprise (a) a flap pivotably attached to a wall of the container via a flap hinge, the container having a plurality of top, side and bottom walls defining a substantially closed interior (b) a pour opening traversing at least one wall of the container, the pour opening comprising a plurality of edge portions, wherein one edge portion of the pour opening comprises the flap hinge, and wherein the flap can enter and exit the pour opening through pivotable movement of the flap at the flap hinge; and (c) a tab attached to a wall of the container, wherein the tab is located along another edge portion of the pour opening such that it protrudes into the pour opening. The pour systems latchably reclose by depressing or sliding the flap past the tab, to the interior of the container. The pour systems can be reopened by moving the flap upward toward the hinge, until it clears the tab and is thereby released to the open position. Alternatively, the tab can be pulled or bent away from the container, thereby releasing the flap to the open position.

As will be understood by the skilled artisan, the type and construction of the flap hinge will depend in part on the materials used to construct the reclosable pour system. For instance, if cardboard, paper board or light plastic is utilized, the flap hinge may be constructed by creasing or folding the flap back and forth at the hinge juncture. The material can be pre-creased or pre-folded in some embodiments.

In certain embodiments, the wall of the container comprises an inner panel and an outer panel, which are adhered to one another. Each of the inner panel and outer panel comprises an opening which collectively forms the pour opening. The inner panel comprises the tab and the outer panel comprises part or all of the flap.

In one embodiment, the pour opening and flap traverse at least a portion of the top wall and an adjacent side wall of the container. Here, the flap hinge is located along an edge of the pour opening on the top wall and the tab is located along an edge of the pour opening along the side wall. In another embodiment, which may be appreciated as the previous embodiment turned on its side, the pour opening and flap traverse at least a portion of two adjacent side walls of the container, the flap hinge is located along an edge of the pour opening on one side wall and the tab is located along an edge of the pour opening along the other side wall. In another embodiment the pour opening and flap traverse at least a portion of a single side wall of the container, the flap hinge is located along an edge portion of the pour opening on the side wall and the tab is located along a different edge portion of the pour opening on the same side wall.

The flap and the pour opening can be substantially the same size and shape. In certain embodiments, the flap hinge and the tab are located along substantially opposite edge portions of the pour opening. In some embodiments as alluded to above, the tab is bendable, so that it may bend inward if the flap is pressed inward to reclose the container, and/or it may be pulled outward to release the flap. Certain embodiments employ a hinge at the tab, which may be formed in the same way as the flap hinge. If a tab hinge is utilized, it should be constructed so as to be sufficiently rigid to hold the flap in place in the closed position.

In another aspect, the invention provides containers. The containers comprise top, bottom, and side walls that define a substantially enclosed interior and at least one reclosable pour system as described above. The containers may be of any size or shape, such as a bottle, cube, box, pyramid, or cylinder, to name a few. The containers can also be made of any suitable material. Suitable materials are well known to persons skilled in the art and include metal, plastic, paperboard, and corrugated cardboard, to name a few.

In various embodiments, the containers contain one or more flowable materials capable of being poured from the container through the reclosable pour system. The flowable material in certain embodiments is a powder or granular material. Examples include, but are not limited to, pet litter, pet food, powdered detergent, or dry foodstuff, such as grains, sugar, baking soda, salt, and spices.

Figure 1B:
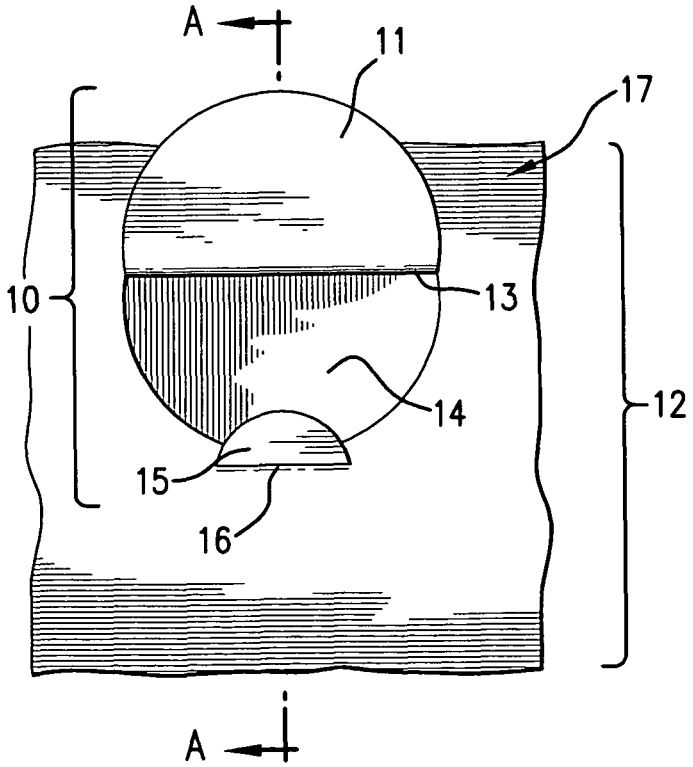
Figure 2A:
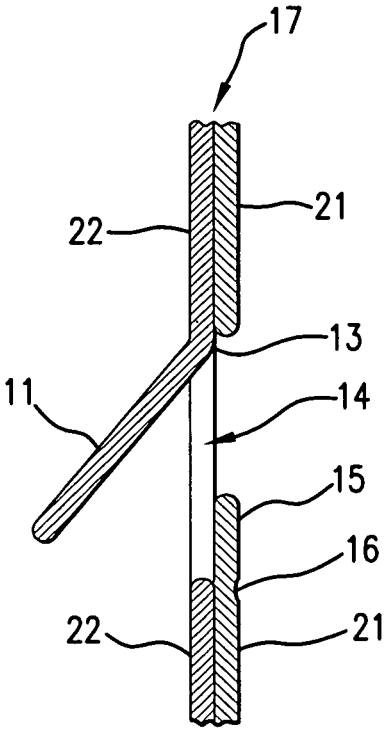
FIG. 2A—hinged flap in the open position.
Figure 2B:
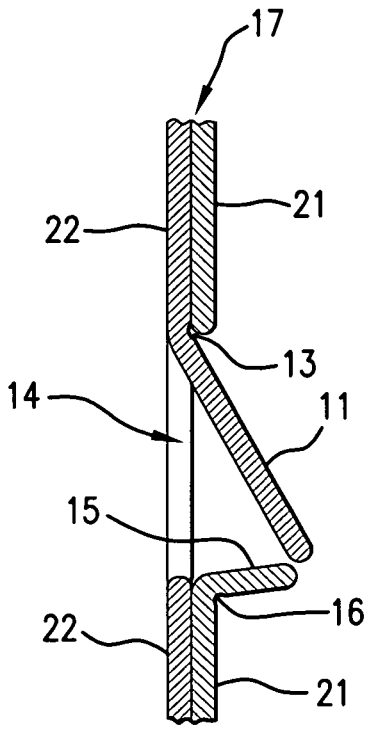
FIG. 2B—hinged flap during the process of being closed.
Figure 2C:
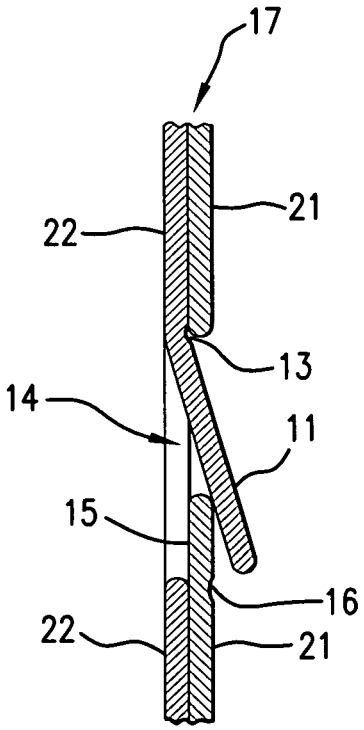
FIG. 2C—hinged flap in the closed position.
Figure 2D:
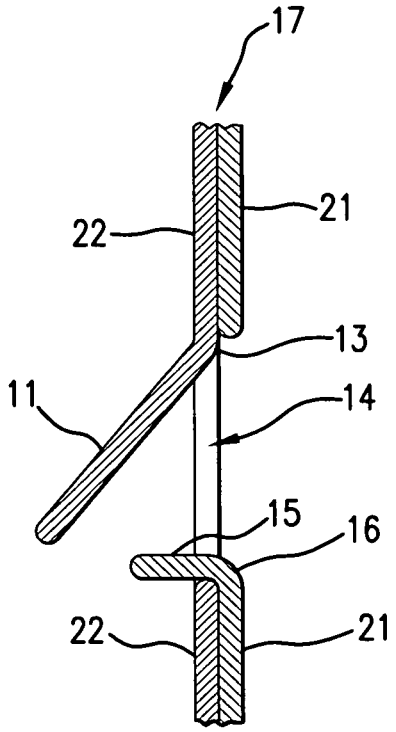
FIG. 2D—hinged flap in the process of being opened.
Figure 3B:
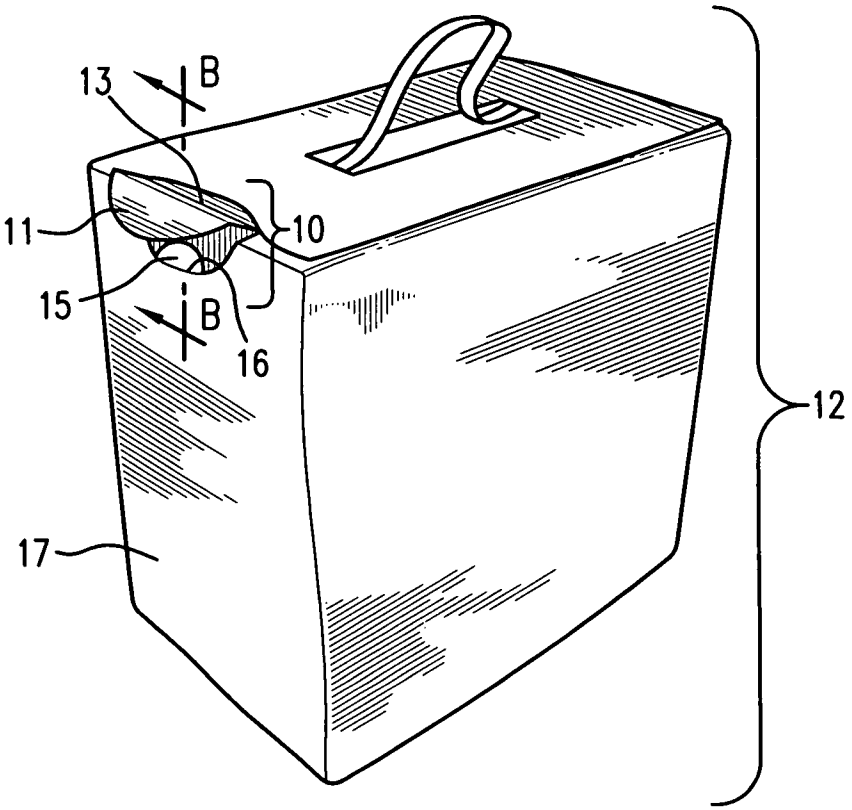
FIG. 3 illustrates a perspective view of a box possessing a reclosable pour system with the hinged flap in the reclosed (FIG. 3A) and open (FIG. 3B) position.
Figure 3A:
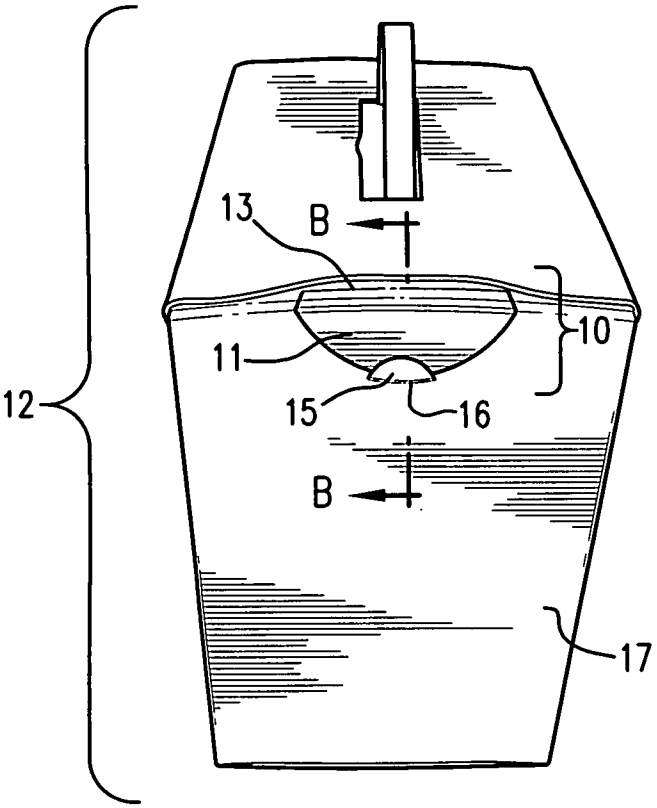

Referring to embodiments shown in FIGS. 1, 2, 3, and 5, reclosable pour system 10 possesses a flap 11, which is attached to container 12 through a flap hinge 13. Flap 11 can be located on a single container wall, such as is illustrated in FIG. 1, where flap 11 is located entirely on wall 17 of container 12. Alternatively, flap 11 can cross the fold junction joining two adjacent walls so that it is located on two walls of the container, for example, partially on the top wall of the container and partially on a side wall, as is shown in FIGS. 3 and 5, or partially on two adjacent side walls. In certain embodiments, the majority of flap 11 is located on a side wall while a minority portion of flap 11, including flap hinge 13, is located on a top wall of the container. Flap 11 can be any shape desired. In certain embodiments, the flap is hemispherical, rectangular, oval, or square shaped. Container 12 also can be any desired shape or size, as mentioned above. For example, FIG. 3 illustrates reclosable pour system 10 on a container which is a box. Flap hinge 13 can be located on any side of flap 11 such that the flap can open in any direction. The flap hinge is preferably located at the top of the flap such that the flap opens in an upward direction, as shown in FIGS. 1-3 and 5. Through flap hinge 13, the flap is able to be pivoted (see FIGS. 2 and 5) to cover and uncover pour opening 14 in container 12, as shown in FIGS. 1A and 1B, respectively.

Pour opening 14 traverses one or more walls of container 12, thereby allowing a flowable material within container 12 to be passed into or out of the container when flap 11 is in the open position. Pour opening 14 can be any shape or size that is desired. In certain embodiments, the pour opening is hemispherical, rectangular, oval, or square shaped. Preferably, the pour opening is substantially the same size and shape as flap 11, thereby allowing flap 11 to be inserted into pour opening 14 without leaving a gap of sufficient size to allow a significant amount of flowable material within container 12 to escape through the gap.

Reclosable pour system 10 also possesses tab 15 attached to or integrated within wall 17 of container 12. Tab 15 is attached to wall 17 of container 12 through optional tab hinge 16 and extends from the edge of and into pour opening 14 such that it is in substantially the same plane as wall 17 of container 12. Though this is the initial position of tab 15, and the position to which it prefers to return in the absence of any bending force, tab 15 is bendable between this first position of being in substantially the same plane as wall 17 of container 12 and a second position in which tab 15 is angled inward such that it is within the interior of container 12. In some embodiments, tab 15 is also bendable to a third position in which tab 15 is angled outward such that it is outside of the inner space of container 12. Tab 15 can be located at any position along the edge of pour opening 14 with the exception of the edge portion of pour opening 14 comprising flap hinge 13. In certain embodiments, tab 15 is located substantially opposite flap hinge 13 on pour opening 14, as is shown in FIGS. 1, 2, and 5. Tab 15 can be any shape desired. In certain embodiments, tab 15 is hemispherical, rectangular, oval, or square shaped. Tab 15 can also be any size desired, so long as tab 15 is sufficiently small to allow flap 11 to be pushed passed tab 15 and into pour opening 14 and sufficiently large to effect latchable closure of the flap.

Preferably, the reclosable pour system is formed by the overlap of inner and outer panels, such as is shown in FIG. 2, wherein inner panel 21 and outer panel 22 make up the reclosable pour system. Similarly, FIG. 5 illustrates an embodiment where the reclosable pour system is formed by the overlap of inner front panel 53 and outer front panel 54 and the overlap of inner top panel 51 and outer top panel 69. In such cases, the pour opening is defined by the overlap of openings in both the inner and outer panels. In certain embodiments, the two panels will be adhered to one another by any suitable means during manufacturing of the container. Even more preferably, the inner panel (i.e., the panel nearer the inner space of the container) includes the tab while the outer panel (i.e., the panel further from the inner space of the container) includes the flap.

FIGS. 2B, 2C, 5B, and 5C illustrate, one way to close reclosable pour system 10. Flap 11 is moved toward pour opening 14. When flap 11 comes into contact with tab 15, continued movement of flap 11 results in tab 15 bending at optional tab hinge 16 such that tab 15 is angled inward and within container 12. This allows flap 11 to be moved into pour opening 14 until flap 11 passes tab 15, at which time tab 15 will, return to its original position of being in the same plane as wall 17 of container 12. When the pressure on flap 11 is subsequently released, tab 15 will not allow flap 11 to exit pour opening 14. By virtue of the presence of flap 11 within pour opening 14, when in the closed position, reclosable pour system 10 stops the passage of flowable material through pour opening 14.

As FIG. 2D illustrates, to open reclosable pour system 10, tab 15 can be bent outward, away from container 12. When tab 15 is angled sufficiently outward, tab 15 will no longer physically block flap 11 from exiting pour opening 14. As such, flap 11 will moved past tab 15, thereby uncovering pour opening 14. When in the open position, reclosable pour system 10 allows flowable material within container 12 to be passed into or out of container 12 via pour opening 14.

Figure 5A:
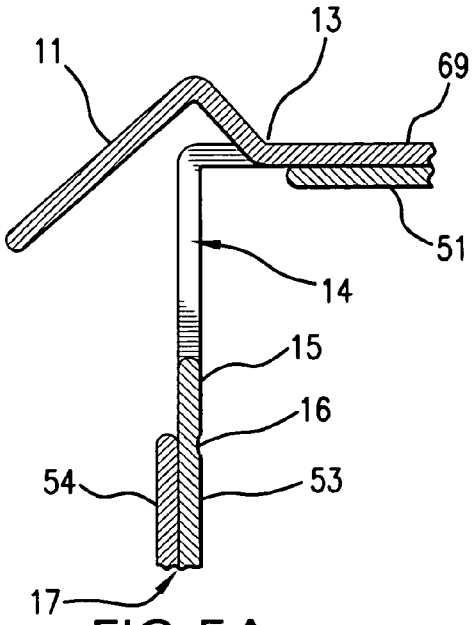
FIG. 5A—hinged flap in the open position.
Figure 5B:
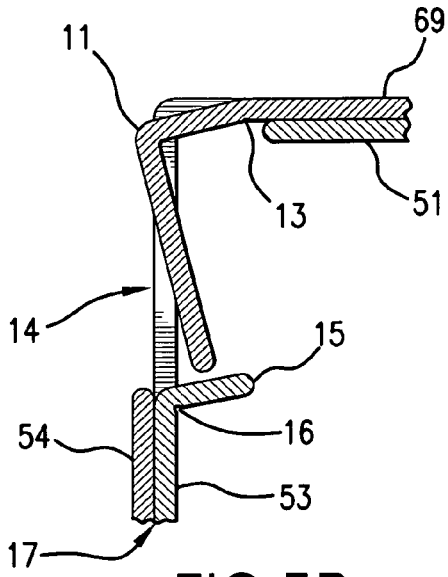
FIG. 5B—hinged flap in the process of being closed.
Figure 5C:
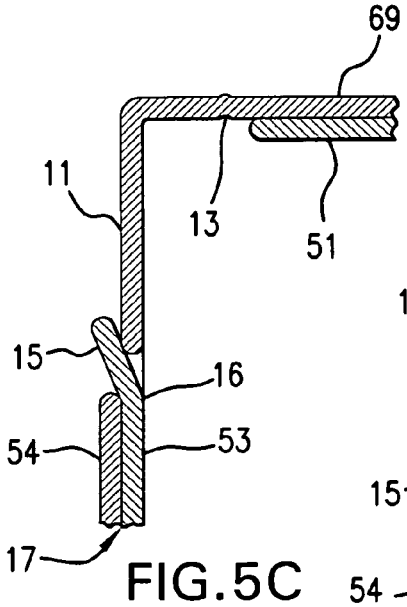
FIG. 5C—hinged flap in the closed position.
Figure 5D:
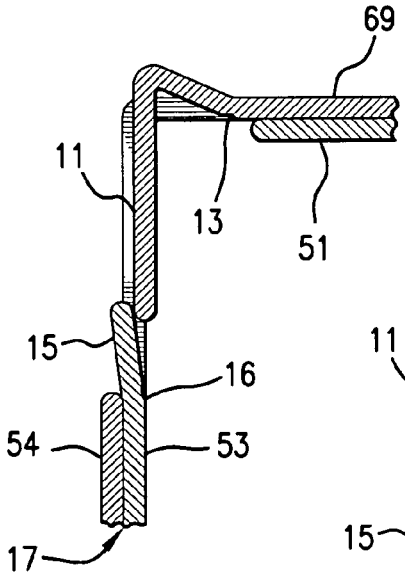
FIGS. 5D and 5E—hinged flap in the process of being opened.
Figure 5E:
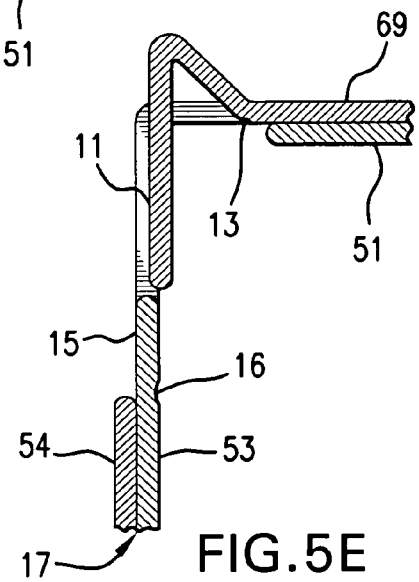

In embodiments in which the reclosable pour system crosses a fold junction such that it is located on two adjacent walls of the container, such as is illustrated in FIGS. 3 and 5, the reclosable pour system 10 can alternatively be reopened as illustrated in FIGS. 5C-5E. To open the reclosable pour system in this manner, flap 11 is pushed upwards, thereby causing the portion of flap 11 located on outer top panel 69 to pivot upwards around flap hinge 13, while the portion of flap 11 located on outer front panel 54 slides upwards in relation to tab 15. When flap 11 has been slid sufficiently far upwards, it will slide past tab 15 (see FIG. 5E), thereby allowing the portion of flap 11 located on the front panel of the container to pivot outwards to the position shown in FIG. 5A, thus uncovering pour opening 14. The pour system can also be reclosed in the same manner, i.e., by sliding the flap behind the tab. One advantage of this embodiment is that the tab does not need to be bendable, nor is a tab hinge needed.

The containers are useful for containing and dispensing various materials, e.g., pourable materials such as some pet foods and litters, e.g., cat litter.

In a further aspect, the invention provides methods for manufacturing containers. The methods comprise scoring, cutting, and/or folding unitary blanks to define a series of panels and fold lines. In one embodiment, a container, such as the container of FIG. 3, is formed from a unitary blank that is scored, cut, and/or folded to define a series of panels and fold lines. The blank can be constructed of any of foldable sheet material suitable for containing the desired material to be placed within the container. Such materials are well known within the art and include plastic, paperboard, and corrugated cardboard. In certain embodiments, the blank will also possess instructions for manufacturing a container from the blank, such as instructions relating to where and how to cut the blank, where and how to fold the blank, and where and how to apply adhesive to the blank. The blank can be cut, scored, and/or folded in any suitable manner to provide a container with a reclosable pour system when the blank has been properly folded and assembled. In certain embodiments, the blank is produced such that the area of the reclosable pour system comprises two or more overlapping panels comprising an inner panel (i.e., the panel nearer the interior of the container) and an outer panel (i.e., the panel further from the interior of the container). Preferably, the inner panel comprises the tab and the outer panel comprises the flap.

Figure 4:
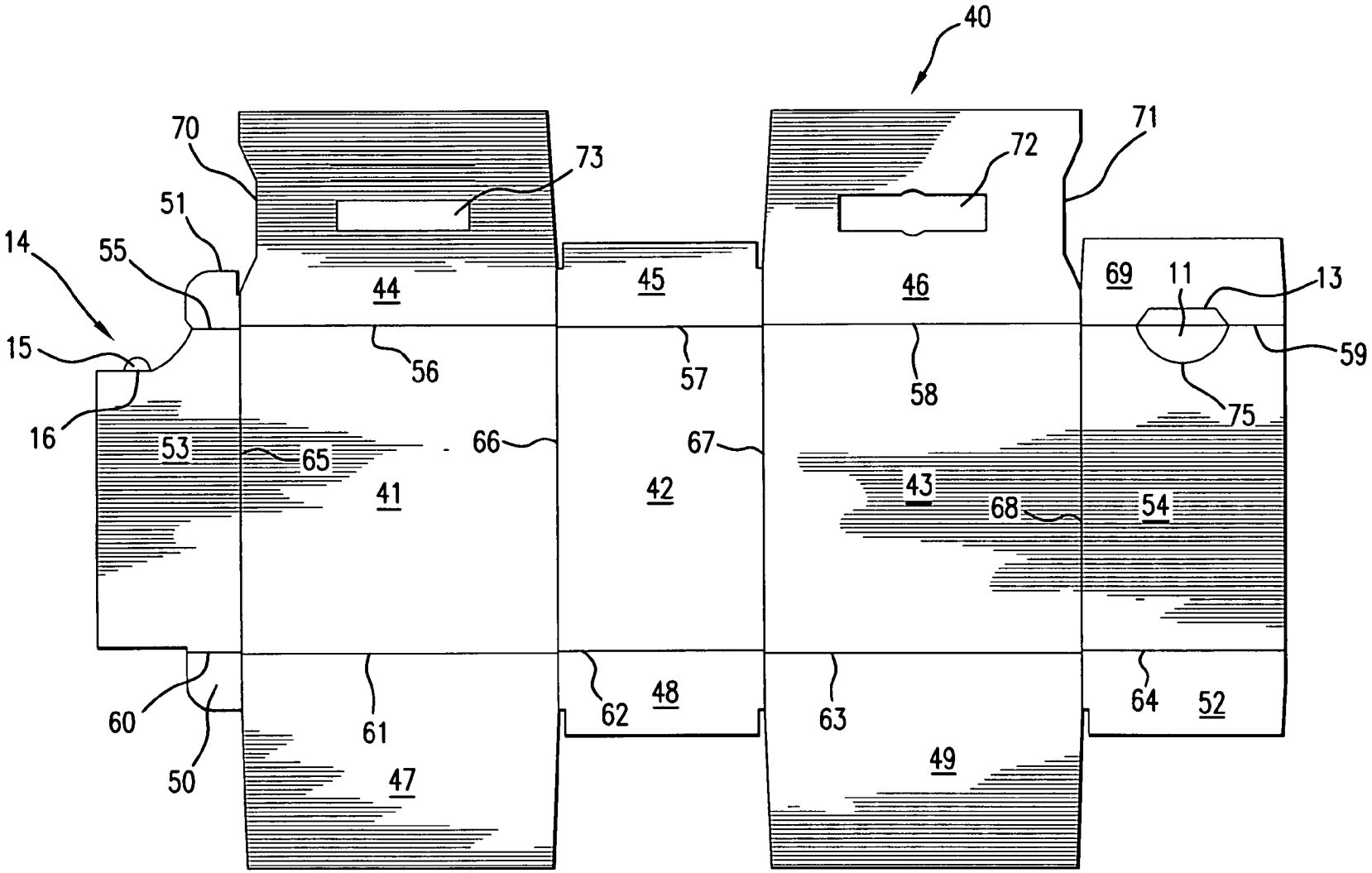
FIG. 4 illustrates a top view of a unitary blank of foldable sheet material used to construct the container illustrated in FIG. 3.

One example of a unitary blank of the present invention can be seen in FIG. 4. Referring to FIG. 4, blank 40 possesses three side panels 41-43, which are adjacent to one another and separated by from one another by longitudinal fold lines 66 and 67. Blank 40 also possesses top panels 44-46, which are adjacent to side panels 41-43, respectively, and separated from side panels 41-43 by horizontal fold lines 56-58. Blank 40 also possesses bottom panels 47-49, which are adjacent to side panels 41-43, respectively, and separated from side panels 41-43 by horizontal fold lines 61-63. Blank 40 further possesses inner front panel 53, which is adjacent to side panel 41 and is separated from side panel 41 by longitudinal fold line 65. Inner front panel 53 is further adjacent to bottom panel 50, from which it is separated by horizontal fold line 60, and inner top panel 51, from which it is separated by horizontal fold line 55. Blank 40 further possesses outer front panel 54, which is adjacent to side panel 43 and is separated from side panel 43 by longitudinal fold line 68. Outer front panel 54 is further adjacent to bottom panel 52, from which it is separated by horizontal fold line 64, and outer top panel 69, from which it is separated by horizontal fold line 59.

Pour opening 14 is located within inner front panel 53 and inner top panel 51, traversing horizontal fold line 55, which separates those two panels. Tab 15 is located along an edge of pour opening 14 on inner front panel 53, such that tab 15 protrudes into pour opening 14. Tab 15 is connected to the edge of pour opening 14 via tab hinge 16.

Flap 11 is located within outer front panel 54 and outer top panel 69, traversing horizontal fold line 59, which separates those two panels. Hinge flap 13 is located along an edge of flap 11 that lies within outer top panel 69. Separation line 75 is located along all remaining edges of flap 11. Separation line 75 allows flap 11 to be partially separated from outer front panel 54 and outer top panel 69 so that flap 11 can be pivotably opened and closed through flap hinge 13. Separation line 75 can be a perforation, scoring, or full cut. Hinge flap 13 connects flap 11 to the container after the flap is separated along separation line 75.

Top panels 44 and 46 also possess cutout areas 70 and 71, respectively, to accommodate the opening of flap 11 at flap hinge 13 when the container is properly folded and assembled. Top panel 46 also possesses handle cutout 72 to accommodate a handle, which can be attached to attachment area 73 of top panel 44. The handle could be any type suitable for the desired container use. Such handles are well known in the art and include plastic, cardboard, and rope handles. The handle can also be attached by any suitable means, including gluing, taping, stapling, or the use of slots and tabs.

Referring to FIG. 4, to assemble the container from blank 40, blank 40 is folded at right angles at all horizontal fold lines 55-64 and longitudinal fold lines 65-68, such that side panels 41 and 43 are substantially parallel to one another and are each substantially perpendicular to side panel 42, inner front panel 53, and outer front panel 54, with outer front panel 54 overlaid on inner front panel 53. Inner front panel 53 and outer front panel 54 are then adhered to one another by any suitable means, including gluing, taping, stapling, or the use of slots and tabs. Bottom panels 47-50 and 52 are then adhered to one another in a suitable manner to cause bottom panels 47 and 49 to be substantially overlaid on one another and to provide a sift proof bottom for the container. Top panels 44-46, inner top panel 51, and outer top panel 69 are then adhered to one another in a suitable manner to cause bottom panels 44 and 46 to be substantially overlaid on one another, to cause inner top panel 51 and outer top panel 69 to be within the confines of the container and adhered to the inside portion of the top wall of the container, and to provide a sift proof top for the container.

In certain embodiments, the reclosable hinge pour flap must be initially opened by separation of the flap from the container wall before use. To initially open the reclosable pour system, flap 11 is separated from outer front panel 54 and outer top panel 69 along separation line 75, thereby freeing flap 11 from front panel 54 and outer top panel 69, except for along flap hinge 13. The container manufacturer, an end user, or any other intermediate entity can perform this separation step. In certain other embodiments, separation line 75 comprises a complete cut, such that the separation is essentially complete prior to container assembly, making the step of separating the flap from the container unnecessary.

In another aspect, the invention provides methods of manufacturing containers having a reclosable pour system of the invention. The methods comprise providing a unitary blank as described above, and producing a container from the unitary blank by folding the unitary blank and adhering the overlapping panels to form the container. In certain embodiments, the unitary blank further comprises manufacturing instructions printed on the blank, and wherein the folding is performed as directed by the manufacturing instructions.

In another aspect, the invention provides containers manufactured using the methods of the invention.

In another aspect, the invention provides methods of obtaining products from a container comprising a reclosable pour system as described above. The methods comprise releasing the flap from its latchably reclosed position over the pour opening, pouring a flowable material from the container through the pour opening, and reclosing the container. The containers may be latchably closed or reclosed by depressing or sliding the flap past the tab to the interior of the containers, and reopened by bending the tab outward to release the flap, or by sliding the flap upward toward the flap hinge, past the tab, as described in detail herein. In certain embodiments, the containers comprise instructions for reclosing and reopening the container using the reclosable pour system.

In yet another aspect, the invention provides products. The products comprise containers of the invention and one or more materials within the containers. The materials can be any material suitable for the container, e.g., pourable materials such as foods, detergents, fertilizers, litters, cereals, pet foods, infant formulas, coffee, and the like. In preferred embodiments, the materials are pet foods, more preferably dog foods and cat foods, or litters.

In the specification, there have been disclosed typical preferred embodiments of the invention and, although specific terms are employed, they are used in a generic and descriptive sense only and not for purposes of limitation. Obviously many modifications and variations of the invention are possible in light of the above teachings. It is therefore to be understood that the invention may be practiced otherwise than as specifically described.

Unless defined otherwise, all technical and scientific terms and any acronyms used herein have the same meanings as commonly understood by one of ordinary skill in the art in the field of this invention. Although any compositions, methods, and means for communicating information similar or equivalent to those described herein can be used to practice this invention, the preferred compositions, methods, and means for communicating information are described herein.

As used herein "comprising" is to be interpreted as specifying the presence of the stated features, integers, steps, or components as referred to, but does not preclude the presence or addition of one or more features, integers, steps, or components, or groups thereof. Thus, for example, a container comprising one tab may have two or three tabs. Additionally, the term "comprising" is intended to include embodiments encompassed by the terms "consisting essentially of" and "consisting of." Similarly, the term "consisting essentially of" is intended to include embodiments encompassed by the term "consisting of."

All references cited above are incorporated herein by reference to the extent allowed by law. The discussion of those references is intended merely to summarize the assertions made by their authors. No admission is made that any reference (or a portion of any reference) is relevant prior art. Applicants reserve the right to challenge the accuracy and pertinence of any cited reference.

What is claimed is:

1. A reclosable pour system for a container, wherein the container comprises a plurality of top, side and bottom walls defining a substantially enclosed interior and the reclosable pour system comprises:

a. a flap pivotably attached to an upper side wall or top wall of the container via a flap hinge;

b. a pour opening traversing at least one upper side wall of the container, the pour opening comprising a plurality of edge portions, wherein a side or top edge portion of the pour opening comprises the flap hinge, and wherein the flap enters and exits the pour opening through pivotable movement of the flap at the flap hinge; and c. a tab attached to a wall of the container, wherein the tab is located along another edge portion of the pour opening such that it protrudes into the pour opening; wherein the pour system latchably recloses by depressing or sliding the flap past the tab, to the interior of the container;

wherein the at least one side wall of the container traversed by the pour opening comprises an inner panel and an outer panel, wherein the inner panel and outer panel overlap along the entire length of the wall and are adhered to one another, wherein each of the inner panel and outer panel comprises an opening which collectively forms the part of the pour opening traversing the wall, and wherein the inner panel comprises the tab and the outer panel comprises part or all of the flap.

2. The reclosable pour system of claim 1 wherein the pour opening and flap traverse at least a portion of the top wall and an adjacent side wall of the container, the flap hinge is located along an edge of the pour opening on the top wall and the tab is located along an edge of the pour opening along the side wall.

3. The reclosable pour system of claim 1 wherein the pour opening and flap traverse at least a portion of a single side wall of the container, the flap hinge is located along an edge portion of the pour opening on the side wall and the tab is located along a different edge portion of the pour opening on the same side wall.

4. The reclosable pour system of claim 1 wherein the pour opening and flap traverse at least a portion of two adjacent upper side walls of the container, the flap hinge is located along a side edge of the pour opening on one side wall and the tab is located along a side edge of the pour opening along the other side wall.

5. The reclosable pour system of claim 1 wherein the flap and the pour opening are substantially the same size and shape.

6. The reclosable pour system of claim 1 wherein the flap hinge and the tab are located along substantially opposite edge portions of the pour opening.

7. The reclosable pour system of claim 1 wherein the tab is bendable.

8. A container comprising:

a. opposing top and bottom walls and at least one side wall bridging the top and bottom walls, wherein the top and bottom walls and sidewalls define a substantially enclosed interior; and b. at least one reclosable pour system comprising:

i. a flap pivotably attached to an upper side wall or top wall of the container via a flap hinge;

ii. a pour opening traversing at least one upper side wall of the container, the pour opening comprising a plurality of edge portions, wherein a side or top edge portion of the pour opening comprises the flap hinge, and wherein the flap enters and exits the pour opening through pivotable movement of the flap at the flap hinge; and iii. a tab attached to a wall of the container, wherein the tab is located along another edge portion of the pour opening such that it protrudes into the pour opening wherein the container latchably recloses by depressing or sliding the flap past the tab, into the interior of the container;

wherein the side wall of the container traversed by the pour opening comprises an inner panel and an outer panel, wherein the inner panel and outer panel overlap along the entire length of the wall and are adhered to one another, wherein each of the inner panel and outer panel comprises an opening which collectively forms the part of the pour opening traversing the wall, and wherein the inner panel comprises the tab and the outer panel comprises part or all of the flap.

9. The container of claim 8 wherein the pour opening and flap traverse at least a portion of the top wall and an adjacent side wall of the container, the flap hinge is located along an edge of the pour opening on the top wall and the tab is located along an edge of the pour opening along the side wall.

10. The container of claim 8 wherein the pour opening and flap traverse at least a portion of a single side wall of the container, the flap hinge is located along an edge portion of the pour opening on the side wall and the tab is located along a different edge portion of the pour opening on the same side wall.

11. The container of claim 8 wherein the pour opening and flap traverse at least a portion of two adjacent upper side walls of the container, the flap hinge is located along a side edge of the pour opening on one side wall and the tab is located along a side edge of the pour opening along the other side wall.

12. The container of claim 8 wherein the container is shaped as a bottle, cube, box, pyramid, or cylinder.

13. The container of claim 8 wherein the container contains one or more flowable materials capable of being poured from the container through the reclosable pour system.

14. The container of claim 13 wherein the flowable material is a powder or granular material.

15. The container of claim 14 wherein the flowable material is a pet litter, pet food, laundry detergent, dishwasher detergent, baking soda, or dry foodstuff.

16. A product comprising the container of claim 8 and one or more materials within the container.

17. The product of claim 16 wherein the material is a litter.

18. The product of claim 17 wherein the material is a cat litter.

* * * * *